US011073366B2

(12) United States Patent
Larson et al.

(10) Patent No.: US 11,073,366 B2
(45) Date of Patent: Jul. 27, 2021

(54) LINERS FOR FLARES AND RELATED METHODS

(71) Applicant: Northrop Grumman Systems Corporation, Falls Church, VA (US)

(72) Inventors: Robert S. Larson, Harrisville, UT (US); Elizabeth K. Bonderson, Pleasant View, UT (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 0 days.

(21) Appl. No.: 16/726,559

(22) Filed: Dec. 24, 2019

(65) Prior Publication Data

US 2021/0190464 A1 Jun. 24, 2021

(51) Int. Cl.
*F42B 4/26* (2006.01)

(52) U.S. Cl.
CPC ..... *F42B 4/26* (2013.01)

(58) Field of Classification Search
CPC ..... F42B 4/26
USPC ..... 102/336
See application file for complete search history.

(56) References Cited

U.S. PATENT DOCUMENTS

| | | | | |
|---|---|---|---|---|
| 3,605,624 | A * | 9/1971 | Dinsdale et al. | F42B 4/28 102/336 |
| 3,736,206 | A * | 5/1973 | Dinsdale et al. | C08L 67/00 156/293 |
| 4,595,714 | A | 6/1986 | McAllister et al. | |
| 4,600,732 | A | 7/1986 | Junior et al. | |
| 4,656,095 | A | 4/1987 | McAllister et al. | |
| 4,956,397 | A | 9/1990 | Rogowski et al. | |
| 6,054,521 | A | 4/2000 | Nelson et al. | |
| 7,341,002 | B1 | 3/2008 | Baker | |
| 7,469,640 | B2 * | 12/2008 | Nielson | C06B 45/12 102/289 |
| 9,194,669 | B2 | 11/2015 | Widener et al. | |
| 9,416,217 | B2 | 8/2016 | Larson et al. | |
| 2004/0065075 | A1 | 4/2004 | Peterson et al. | |
| 2019/0016645 | A1 | 1/2019 | Larson et al. | |

* cited by examiner

*Primary Examiner* — Reginald S Tillman, Jr.
(74) *Attorney, Agent, or Firm* — TraskBritt

(57) ABSTRACT

A flare comprising an illuminant adjacent to a casing of a flare and a liner between the casing and the illuminant. The liner comprises a reaction product of a prepolymer and a curative, and one or more of a zinc oxide material or an aluminum oxide material. Methods of forming a flare are also disclosed.

20 Claims, 3 Drawing Sheets

LINERS FOR FLARES AND RELATED METHODS

TECHNICAL FIELD

Embodiments of the disclosure relate generally to compositions suitable for use as a liner of a flare. More particularly, embodiments of the disclosure relate to flares having liners including one or more of a zinc oxide material or an aluminum oxide material, and to related methods.

BACKGROUND

Flares are pyrotechnic devices designed and configured to emit intense electromagnetic radiation at wavelengths in the visible region (e.g., visible light) of the electromagnetic radiation spectrum, the infrared (IR) region (e.g., heat) of the electromagnetic radiation spectrum, or both without exploding or producing an explosion. Flares have been used for signaling, illumination, and defensive countermeasures in civilian and military applications. The electromagnetic radiation emissions of the flare are produced by combustion of a flare composition that is conventionally referred to as the "grain" of the flare.

A flare conventionally includes an illuminant in a casing and a liner between the illuminant and the casing. The flare also includes a liner, such as a liner composition including a polymer and carbon black. During use and operation of the flare, combustion of the illuminant may cause premature disintegration of the casing and the liner. For instance, gases produced during the illuminant combustion contain high-energy particles and sufficient heat that the liner may be compromised, leading to side burning and coning of the illuminant, which may result in undesirably short burn times and anomalous illumination intensities of the flare. Conventional flares, therefore, do not meet burn time and illumination intensity requirements.

BRIEF SUMMARY

In accordance with some embodiments, a flare is disclosed. The flare comprises an illuminant adjacent to a casing of a flare and a liner between the casing and the illuminant. The liner comprises a reaction product of a prepolymer and a curative, and one or more of a zinc oxide material or an aluminum oxide material.

In accordance with other embodiments, a method of forming a flare is disclosed. The method comprises forming a precursor liner composition comprising a prepolymer, one or more of a zinc oxide material or an aluminum oxide material, and a curative. The precursor liner composition is applied to a casing or to an illuminant of a flare and the precursor liner composition is cured to form a liner on the casing or on the illuminant.

In additional embodiments, a method of forming a flare is disclosed. The method comprises forming a precursor liner composition comprising a prepolymer, one or more of zinc borate or aluminum trihydroxide, and a curative. The precursor liner composition is cured to form a liner and the liner is applied to at least a portion of a casing or to at least a portion of an illuminant of a flare.

DETAILED DESCRIPTION

Figure 1:
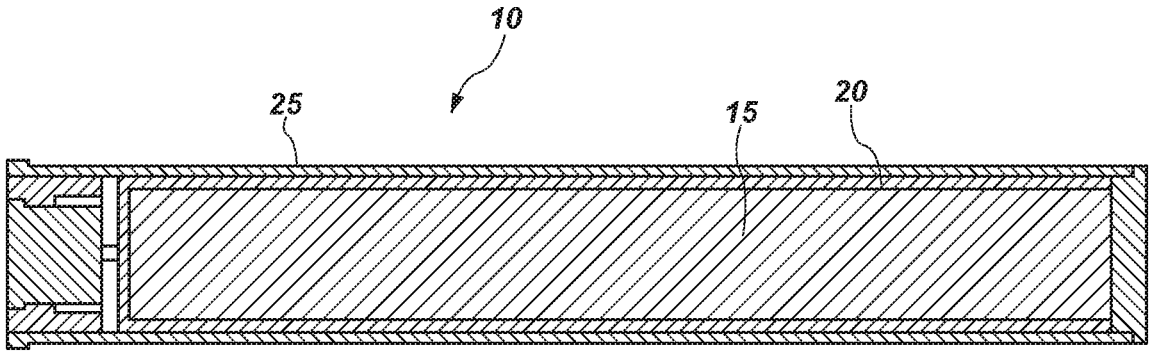
FIG. 1 is a simplified cross-sectional view of a flare including a liner according to embodiments of the disclosure.

A flare including a liner is disclosed, where the liner includes one or more of a zinc-containing material and an aluminum-containing material. The zinc-containing material is a zinc oxide material and the aluminum-containing material is an aluminum oxide material. By way of example only, the zinc oxide material may be zinc borate and the aluminum oxide material may be aluminum trihydroxide (ATH). The zinc borate or the ATH functions as a filler in the liner. The liner also includes a reaction product of a prepolymer and a curative, with the one or more fillers dispersed in the reaction product of the prepolymer and the curative. The liner is substantially free of carbon black and is substantially free of fibers. The liner is formed from a precursor liner composition that includes the one or more of zinc borate or aluminum trihydroxide, the prepolymer, and the curative. The prepolymer of the precursor liner composition is reacted (e.g., cured) to form the liner. The liner is positioned between a casing and an illuminant (e.g., grain) of the flare. The liner provides thermal protection during use and operation of the flare, reducing damage to the flare and to the illuminant. The flare may be an illuminating flare, a signaling flare, etc.

As used herein, the singular forms "a," "an," and "the" are intended to include the plural forms as well, unless the context clearly indicates otherwise.

As used herein, the term "about" or "approximately" in reference to a numerical value for a given parameter is inclusive of the numerical value and has the meaning dictated by the context (e.g., it includes the degree of error associated with measurement of the given parameter). For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the term "and/or" includes any and all combinations of one or more of the associated listed items.

As used herein, spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (e.g., rotated 90 degrees, inverted, flipped, etc.) and the spatially relative descriptors used herein interpreted accordingly.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the term "configured" refers to a size, shape, material composition, and arrangement of one or more of at least one structure and at least one apparatus facilitating operation of one or more of the structure and the apparatus in a pre-determined way.

As used herein, the term "flare" means and includes a pyrotechnic device designed and configured to emit electromagnetic radiation at wavelengths in one or more of the visible region (e.g., visible light) or the infrared (IR) region (e.g., heat) of the electromagnetic radiation spectrum without exploding or producing an explosion. The flare may include, but is not limited to, a signaling flare, an illuminating flare, a defensive countermeasure flare (e.g., a decoy flare), etc. used in civilian or military applications.

As used herein, the term "illuminant" means and includes a composition formulated to emit electromagnetic radiation at wavelengths in one or more of the visible region (e.g., visible light) of the electromagnetic radiation spectrum or the infrared (IR) region of the electromagnetic radiation spectrum.

As used herein, the term "liner" means and includes a composition including a reaction product of a precursor liner composition following cure of the precursor liner composition.

As used herein, the term "precursor liner composition" means and includes a composition that includes a prepolymer, one or more of a zinc oxide material or an aluminum oxide material, and a curative, before the ingredients are reacted (e.g., cured).

As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be excluded.

As used herein, the term "substantially," in reference to a given parameter, property, or condition, means to a degree that one of ordinary skill in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

The following description provides specific details, such as materials, material thicknesses, and processing conditions in order to provide a thorough description of embodiments of the disclosure. However, a person of ordinary skill in the art will understand that the embodiments of the disclosure may be practiced without employing these specific details. Indeed, the embodiments of the disclosure may be practiced in conjunction with conventional fabrication techniques employed in the industry. In addition, the description provided below does not form a complete process flow for manufacturing the flare that includes the liner. Only those process acts and structures necessary to understand the embodiments of the disclosure are described in detail below. Additional acts to form the flare may be performed by conventional techniques. Also note, any drawings accompanying the application are for illustrative purposes only, and are thus not drawn to scale. Additionally, elements common between figures may retain the same numerical designation.

The prepolymer of the precursor liner composition may be a polyester prepolymer, a hydrocarbon prepolymer, or a polyether prepolymer including, but not limited to, a hydroxyl-terminated polybutadiene (HTPB) (e.g., R45M), a hydroxyl-terminated polyether (HTPE), a hydroxyl-terminated polyester, a carboxyl-terminated polybutadiene (CTPB), a carboxyl-terminated polyester, a carboxyl terminated polybutadiene-acrylonitrile (CTBN), ethylene propylene diene monomer (EPDM), acrylonitrile butadiene rubber (NBR), or a combination thereof. Reactive chemical groups of the prepolymer, such as hydroxyl groups, carboxyl groups, or double bonds, react with a curative to form polyurethane linkages, polyurea linkages, polyester linkages, or hydrocarbon linkages. Following the reaction (e.g., the cure), the prepolymer forms a polymer matrix in which the one or more of the zinc-containing material and the aluminum-containing material is dispersed. The prepolymer may account for from about 40 wt % to about 80 wt % of the precursor liner composition, such as from about 40 wt % to about 70 wt %, from about 40 wt % to about 65 wt %, from about 40 wt % to about 60 wt %, from about 40 wt % to about 55 wt %, from about 45 wt % to about 80 wt %, from about 50 wt % to about 80 wt %, from about 55 wt % to about 80 wt %, from about 60 wt % to about 80 wt %, from about 65 wt % to about 80 wt %, or from about 70 wt % to about 80 wt %.

In some embodiments, the prepolymer is HTPB. HTPB is commercially available from numerous sources, such as from CRS Chemicals (Canoga Park, Calif.) as R45M or from Cray Valley Hydrocarbon Specialty Chemicals (Exton, Pa.) under the POLY BD® tradename. In other embodiments, the prepolymer is HTPE, which is commercially available from numerous sources, such as from BASF Corp. (Florham Park, N.J.) under the PLURACOL® or POLY-THF® tradenames. In other embodiments, the prepolymer is an acid terminated polyester prepolymer, which is commercially available from numerous sources, such as from Chemtura Corp. (Middlebury, Conn.) under the FOMREZ® tradename, such as FOMREZ° F.17-80.

In yet other embodiments, the prepolymer is EPDM, which is a terpolymer of ethylene, propylene, and a non-conjugated diene. The non-conjugated diene may include, but is not limited to, ethylidene norbornene (ENB). The EPDM may be linear or branched, e.g., including controlled long chain branching (LCB). Using a linear EPDM or branched EPDM may affect the extent of reaction (e.g., crosslinking) of the precursor liner composition following cure in addition to properties of the uncured precursor liner composition and cured precursor liner composition. The EPDM may have a diene content of from about 1% by weight (wt %) to about 10 wt %, such as about 5.0 wt %. The EPDM may have an ethylene content of greater than about 40 wt %, such as between about 40 wt % and about 85 wt %, between about 40 wt % and about 75 wt %, or between about 45 wt % and about 55 wt %. In some embodiments, the EPDM has an ethylene content of about 50 wt % or about 53 wt %. EPDM is commercially available from numerous sources, such as from Dow Chemical Company (Midland, Mich.) under the NORDEL® tradename or from LANXESS Deutschland GmbH (Marl, Germany) under the KELTAN® tradename.

In yet other embodiments, the prepolymer is a hydroxyl-terminated polypropylene glycol, such as polypropylene glycol, polytetramethylene glycol, or polytetrahydrofuran.

The zinc-containing material may include, but is not limited to, zinc borate or a hydrated form of zinc borate, such as $2ZnO.3B_2O_3.3.5H_2O$, $2ZnO.3B_2O_3$, $4ZnO.6B_2O_3.7H_2O$, $2ZnO.2B_2O_3.3H_2O$, or a combination thereof. Zinc borate is commercially available from numerous sources, such as from U.S. Borax, Inc. (Chicago, Ill.) under the FIREBRAKE® tradename. The zinc borate may be used in particle form, with average particle sizes ranging between about 5 μm and about 50 μm.

The aluminum-containing material may include, but is not limited to, aluminum trihydroxide (ATH), which has the chemical formula of $Al(OH)_3$, or a hydrated form of ATH. ATH is also known in the art as aluminum hydroxide or hydrated alumina. The ATH may be used in particle form, with average particle sizes ranging between about 5 μm and about 50 μm.

The precursor liner composition may include from about 10.0 wt % to about 65.0 wt % of the filler material, such as the zinc-containing material, the aluminum-containing material, or a combination thereof. The filler material may be present at from about 15.0 wt % to about 45.0 wt %, from about 15.0 wt % to about 40.0 wt %, from about 15.0 wt % to about 35.0 wt %, from about 15.0 wt % to about 30.0 wt %, from about 20.0 wt % to about 45.0 wt %, from about 20.0 wt % to about 40.0 wt %, or from about 20.0 wt % to about 30.0 wt %. In some embodiments, the precursor liner composition includes zinc borate. In other embodiments, the precursor liner composition includes zinc borate and aluminum trihydroxide.

If the precursor liner composition includes the zinc borate and aluminum trihydroxide, a total amount of the filler (i.e., the zinc-containing material and the aluminum-containing material) may fall within the ranges discussed above. By way of example only, the precursor liner composition may include 5 wt % of zinc borate and 35 wt % of ATH, 10 wt % of zinc borate and 30 wt % of ATH, 15 wt % of zinc borate and 25 wt % of ATH, 20 wt % of zinc borate and 20 wt % of ATH, 25 wt % of zinc borate and 15 wt % of ATH, 30 wt % of zinc borate and 10 wt % of ATH, or 35 wt % of zinc borate and 5 wt % of ATH. In some embodiments, the precursor liner composition includes equal amounts of the zinc borate and aluminum trihydroxide.

In addition to the one or more of zinc borate or ATH, other oxides may optionally be present as a filler, such as titanium dioxide or silicon dioxide. Glass microspheres, ceramic microspheres, a mixture of hydromagnesite and huntite, or a combination thereof may also, optionally, be present in the precursor liner composition. The microspheres may include, but are not limited to, hollow glass microspheres, hollow polymeric microspheres, hollow ceramic microspheres, or a combination thereof may be present in the precursor liner composition as a filler. Such microspheres are commercially available from numerous sources, such as from 3M (Maplewood, Minn.). The glass or ceramic microspheres may provide a lower density to the liner in addition to the thermal protection. The hydromagnesite and huntite is commercially available from LKAB Minerals (Lulea, Sweden) as ULTRACARB® LH15C. In yet other embodiments, the precursor liner composition includes zinc borate, aluminum trihydroxide, and titanium dioxide. If the precursor liner composition includes the zinc borate, aluminum trihydroxide, and an additional filler, a total amount of the filler may fall within the ranges discussed above.

The curative may include, but is not limited to, an isocyanate curative, an epoxy curative, or a peroxide curative, and is selected based on the prepolymer used in the precursor liner composition. By way of example only, the HTPB may be reacted with the isocyanate curative to form a polyurethane polymer and the EPDM may be reacted with the peroxide curative to form a crosslinked EPDM polymer. The curative may be present in the precursor liner composition at from about 0.1 wt % to about 20%. The isocyanate curative may be an aliphatic isocyanate, a cycloaliphatic isocyanate, or an aromatic isocyanate, such as isophorone diisocyanate (IPDI), IPDI trimers, dimer diisocyanate (DDI), dicyclohexylmethane-4,4'-diisocyanate (H12MDI), hexamethylene diisocyanate (HDI), HDI trimers, e.g., N100, N3200, cyclohexyl diisocyanate (CHDI), tetramethyl xylene diisocyanate (TMXDI), methylene diphenyl diisocyanate (MDI), polymeric MDI (pMDI), para-phenylene diisocyanate (PPDI), toluene diisocyanate (TDI), or a combination thereof. Such isocyanates are commercially available from numerous sources, such as Evonik Industries AG (Marl, Germany), BASF Corp. (Florham Park, N.J.), Dow Chemical Company (Midland, Mich.), Bayer MaterialScience AG (Leverkusen, Germany), or Huntsman Corp. (The Woodlands, Tex.). In some embodiments, the isocyanate is DDI.

The peroxide curative may be a crosslinking peroxide, such as that commercially available from Arkema Inc. (Exton, Pa.) under the LUPEROX® tradename. One or more curatives may be used. By way of example only, the curative may be LUPEROX® 231 XL40, which is a 40% active dispersion of LUPEROX® 231 (1,1-di-(t-butylperoxy)-3,3,5-trimethylcyclohexane) polymer initiator on calcium carbonate. The 1,1-di-(t-butylperoxy)-3,3,5-trimethylcyclohexane polymer initiator may also be used in pure form, such as without the inert support. Alternatively, the curative may be dicumyl peroxide (DCP), which may be used in pure form or with an inert support. In some embodiments, the peroxide is DCP.

The epoxy curative may be a polyglycidyl ether, such as glycerol glycidyl ether, such as that commercially available from Raschig GMBH/PMC Specialties as GE 100.

Depending on the desired mechanical and physical properties of the liner, other additives may optionally be present in the composition, such as a plasticizer, a diluent, an antioxidant, a cure catalyst, a flame retardant, a thixotrope, or a combination thereof. The optional additives may also be used to facilitate processing and curing of the precursor liner formulation. In some embodiments, the additive includes microfine silicon dioxide, such as CAB-O-SIL®, at from about 0.5% to about 5.0%, such as from about 1.0% to about 3.0% or from about 3.0% to about 5.0% to facilitate processing. The microfine silicon dioxide may have a particle size of between about 0.05 μm and about 1 μm.

The catalyst, if present, may include, but is not limited to, dibutyltin dilaurate (DBTDL), triphenylbismuth (TPB), dinitrosalicylic acid (DNSA), magnesium carbonate, dibutyltin diacetate, or a combination thereof. The catalyst may be selected based on other ingredients in the composition, such as the binder. If present, the catalyst may account for from about 0.1% wt % to about 1 wt % of the composition. In some embodiments, the catalyst includes triphenylbismuth and dinitrosalicylic acid.

In some embodiments, the precursor liner composition includes ZnB, ATH, HTPB, DDI, TPB, and DNSA.

The precursor liner composition may be formed by combining (e.g., mixing) the prepolymer, the zinc oxide material, the aluminum oxide material, and the curative. The precursor liner composition may be combined by conventional techniques, such as by hand, using a high shear mixer, or using a planetary mixer, and for an amount of time sufficient to form a substantially homogeneous precursor liner composition. A solvent may be added with the other ingredients to achieve a desired viscosity of the precursor liner composition. During mixing, the precursor liner composition may be maintained at a temperature below the lowest cure temperature of each of the ingredients to inhibit potential reactions from occurring during the mixing. The ingredients may be combined at a temperature of between about 15° C. and about 60° C. The ingredients of the precursor liner composition may be combined in any order to produce the precursor liner composition.

The ingredients of the precursor liner composition may be cured (e.g., reacted) to form the liner. The curing may occur at room temperature (between about 20° C. and about 25° C.) or may be accelerated by applying at least one of heat and pressure. For example, the precursor liner composition may be cured at a temperature between about 15° C. and about 80° C., such as between about 15° C. and about 70° C., between about 15° C. and about 60° C., between about 20° C. and about 70° C., between about 20° C. and about 65° C., between about 20° C. and about 60° C., between about 25° C. and about 70° C., between about 25° C. and about 65° C., between about 25° C. and about 60° C., between about 30° C. and about 60° C., between about 35° C. and about 60° C., between about 40° C. and about 60° C., between about 45° C. and about 60° C., between about 50° C. and about 60° C., or between about 55° C. and about 65° C. During curing, the prepolymer reacts (e.g., crosslinks), forming the liner including the zinc borate and ATH in the polymer matrix. The precursor liner composition may be applied to a desired surface of the flare and then cured or the precursor liner composition may be cured and the resulting liner applied to the desired surface of the flare. The precursor liner composition may be applied by spraying, brushing, or other conventional technique. The liner may be cast, pressed, extruded, molded, cured, or machined into a desired shape or configuration. The precursor liner composition may be applied to the casing or to the illuminant of the flare and then cured to form the liner. Alternatively, the cured precursor liner composition (i.e., the liner) may be applied to the casing or to the illuminant of the flare. In some embodiments, the liner is formed by casting.

The liner of the flare according to embodiments of the disclosure may be configured as a thin layer between the casing and the illuminant and exhibits the desired thermal protection. The liner may also provide adhesion to the illuminant. The liner may have a thickness of from about 10 mm to about 100 mm. The liner may have a single chemical composition across a thickness thereof. In other words, the liner may be a homogeneous composition across its thickness, with the zinc borate and the ATH homogeneously dispersed throughout the polymer matrix.

The liner according to embodiments of the disclosure may exhibit enhanced thermal stability compared to a conventional liner containing carbon black. The liner may exhibit sufficient mechanical properties and thermal properties after curing to provide the desired thermal protection to the casing and to the illuminant, such as by preventing degradation of the casing and side burning of the illuminant. Unlike with conventional flare liners, the desired thermal protection may be achieved by the liner according to embodiments of the disclosure without including fibers or carbon black in the precursor liner composition. The liner according to embodiments of the disclosure, therefore, provides sufficient thermal protection to the flare without including the fibers, the presence of which may negatively affect processing of the precursor liner composition. The liner may be substantially free of fibers, such as carbon fibers, aramid fibers, polybenzimidazole (PBI) fibers, or other conventional fibers used in liners. The liner may also be substantially free of carbon black since the carbon black does not provide sufficient thermal protection.

FIG. 1 illustrates a flare 10 according to embodiments of the disclosure that includes an illuminant 15 (e.g., a grain) and a liner 20 formed from a precursor liner composition according to embodiments of the disclosure. The illuminant 15 is contained in a casing 25 of the flare 10. The casing 25 may have a first end, e.g., the aft end, from which the illuminant 15 is ignited, and a second end, e.g., the forward end opposite from the aft end, from which the illuminant 15 is ejected upon ignition. The casing 25 may be a conventional metal casing 25, such as a conventional aluminum casing 25. For simplicity, an igniter for igniting the illuminant 15 is not shown in FIG. 1. The liner 20 is positioned between the casing 25 and the illuminant 15 and may be bonded to one or more of the casing 25 and the illuminant 15. The liner 20 is compatible with the casing 25 and the illuminant 15. While FIG. 1 illustrates the liner 20 as contacting substantially all of the casing 25 and the illuminant 15, the liner 20 may be present on only a portion of the casing 25 and the illuminant 15, such as on locations of the casing 25 and the illuminant 15 that are subjected to higher temperatures. The liner 20 may, for example, be attached (e.g., bonded) to an inner surface of the casing 25, and separates the casing 25 from the illuminant 15. Alternatively, the liner 20 may be attached (e.g., bonded) to an outer surface of the illuminant 15, separating the casing 25 from the illuminant 15. The liner 20 may provide reliable bonding between the casing 25 and illuminant 15. While FIG. 1 illustrates the liner 20 as being in direct contact with one or more of the casing 25 or the illuminant 15, one or more materials may intervene between the liner 20 and the casing 25 or between the liner 20 and the illuminant 15. For example, a paper tube or a cardboard tube may be present between the liner 20 and the casing 25 or between the liner 20 and the illuminant 15. The additional materials may, for example, reduce mechanical stress on the illuminant 15, reducing cracking in the illuminant 15.

The illuminant 15 may be any illuminant that provides, upon combustion, the desired spectral performance properties to the flare 10. By way of example only, the illuminant 15 may be a slow burning, end-burning illuminant 15 that produces a large amount of heat upon combustion of the illuminant 15. Examples of illuminants 15 are disclosed in U.S. patent application Ser. No. 14/190,417, filed Feb. 26, 2014, and Ser. No. 14/553,785, filed Nov. 25, 2014, the disclosure of each of which is incorporated by reference herein in its entirety. By way of example only, the illuminant 15 may burn at a temperature of about 2000 Kelvin or greater, such as about 2200 Kelvin or greater or about 2500 Kelvin or greater. However, other illuminants 15 may also be used. In some embodiments, the illuminant 15 is formulated to predominantly produce IR radiation upon combustion. In other embodiments, the liner 20 is used with a castable illuminant 15. With the liner 20 positioned between the casing 25 and the illuminant 15, no side burning of the illuminant 15 occurs and the casing 25 remains intact during use and operation of the flare 10. In addition, the burn time and illumination intensity of the illuminant 15 are within acceptable (e.g., expected) ranges. By way of example only, the burn time may range from about 1 minute to about 15 minutes, such as from about 1 minute to about 10 minutes, or from about 1 minute to about 5 minutes. In contrast, if a conventional liner including carbon black is used in the flare 10, side burning of the illuminant 15 and disintegration of the casing 25 occur, and the flare exhibits a short burn time and anomalous illumination intensity, such as a short and bright illumination intensity. The liner 20 according to embodiments of the disclosure, therefore, increases the burn time and provides improved illumination intensity to the flare 10 compared to a conventional flare containing a conventional liner including carbon black. The liner 20 according to embodiments of the disclosure protects the casing 25 from thermal effects during use and operation of the flare 10.

Without being bound by any theory, it is believed that the liner 20 provides comparable or greater thermal protection in the low pressure, low burn rate, non-propulsive environment of the flare 10 compared to the conventional carbon black containing liner in a conventional flare. Without being bound by any theory, it is also believed that the fillers (i.e., the zinc borate and the ATH) in the liner 20 produce water during use and operation of the flare 10, reducing the temperature at which the illuminant 15 burns. By reducing the temperature at which the illuminant 15 burns, the casing 25 may be subjected to lower temperatures. Therefore, the liner 20 according to embodiments of the disclosure provides thermal protection even in the high temperature environment of the flare 10.

While the liner 20 is described above as being used in a flare, the liner 20 may also be used in other pyrotechnic devices, such as in a countermeasure device (e.g., a decoy flare).

The following examples serve to explain embodiments of the disclosure in more detail. These examples are not to be construed as being exhaustive or exclusive as to the scope of this disclosure.

EXAMPLES

Example 1

Compositions 1-5

Precursor liner compositions including the ingredients in Tables 1 and 2 were formed. The ingredients were combined (e.g., mixed) to produce the precursor liner compositions. The precursor liner compositions were then cured at about 135° F. (about 57° C.), producing liner compositions containing the zinc borate or the zinc borate and ATH.

TABLE 1

Ingredients of Compositions 1-3

| Ingredient | Comp. 1 Amount (wt %) | Comp. 2 Amount (wt %) | Comp. 3 Amount (wt %) |
|---|---|---|---|
| HTPB | 45.94 | 45.94 | 58.60 |
| DDI | 12.73 | 12.73 | 16.25 |
| ATH | 19.61 | 0 | 12.5 |
| ZnB | 19.61 | 39.22 | 12.5 |
| TPB | 0.10 | 0.1 | 0.1 |
| Dinitrosalicylic acid | 0.05 | 0.05 | 0.05 |
| Microfine silicon dioxide | 1.96 | 1.96 | 0 |

TABLE 2

Ingredients of Compositions 4 and 5

| Ingredient | Comp. 4 Amount (wt %) | Comp. 5 Amount (wt %) |
|---|---|---|
| Polyester prepolymer (acid terminated) | 37.47 | 45.55 |
| Glycerol glycidyl ether | 9.53 | 11.56 |
| ATH | 20.00 | 0 |
| ZnB | 20.00 | 40.00 |
| TPB | 0.10 | 0.10 |
| Dinitrosalicylic acid | 0.05 | 0.05 |
| Titanium dioxide | 10.00 | 0 |
| Microfine silicon dioxide | 2.00 | 2.00 |
| Iron 2-ethyl-hexanoate (6%) | 1.00 | 1.00 |

Example 2

Control Compositions

A composition that included 24% by weight carbon black in HTPB was produced as a negative control. Two EPDM compositions that included silica fibers or aramid fibers were produced as additional controls. The control compositions were formed by conventional techniques.

Example 3

Torch Testing

Torch testing was conducted on Composition 3 of Example 1 and the control compositions of Example 2 to determine thermal stability of the composition. A front side of samples of each of the compositions was subjected to heat (20 BTU/square-foot/sec (BSF)) from an oxygen-propane torch while monitoring the temperature on the back side of the samples. The samples were exposed to temperatures typically observed during use and operation of a flare.

Figure 2:
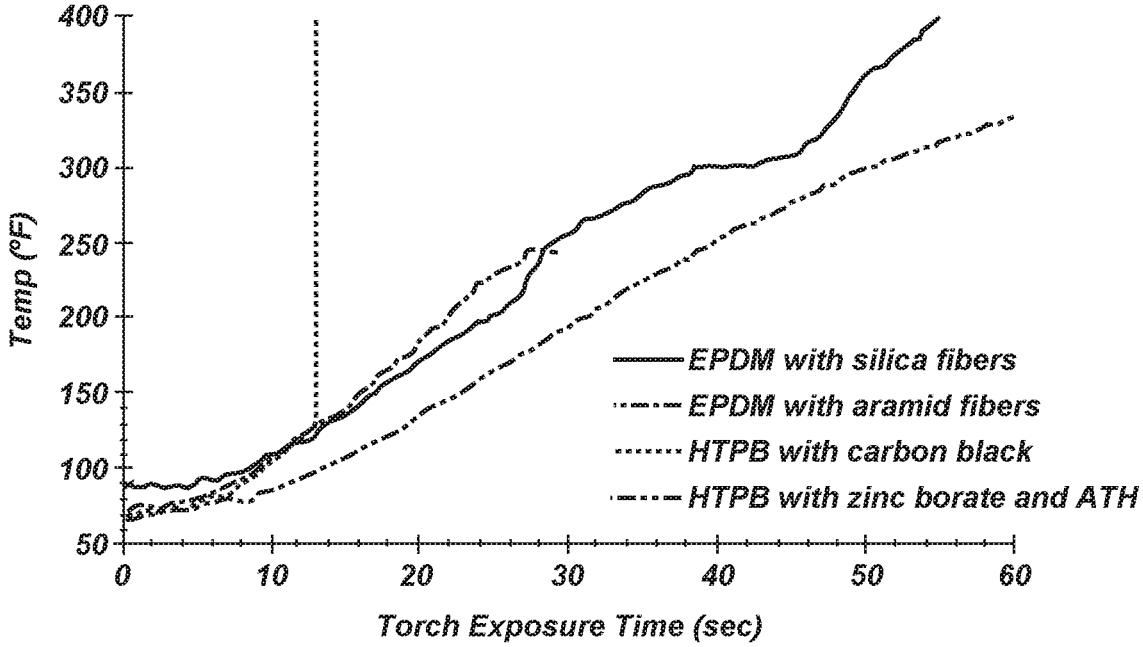
FIG. 2 is a graph illustrating torch testing as a function of exposure time of a liner in accordance with embodiments of the disclosure compared to control samples.

As shown in FIG. 2, Composition 3 provided improved thermal protection compared to the control compositions. The thermal protection provided by Composition 3 lasted for about 60 seconds or more, with a slow temperature rise on the back side of the sample over that time. In contrast, the carbon black/HTPB composition provided thermal protection for only about 12 seconds before burning through. Therefore, Composition 3 provided significantly increased thermal protection compared to the negative control. Composition 3 also exhibited comparable thermal protection as the fiber-containing compositions of Example 2.

Example 4

Spectral Performance

Figure 3:
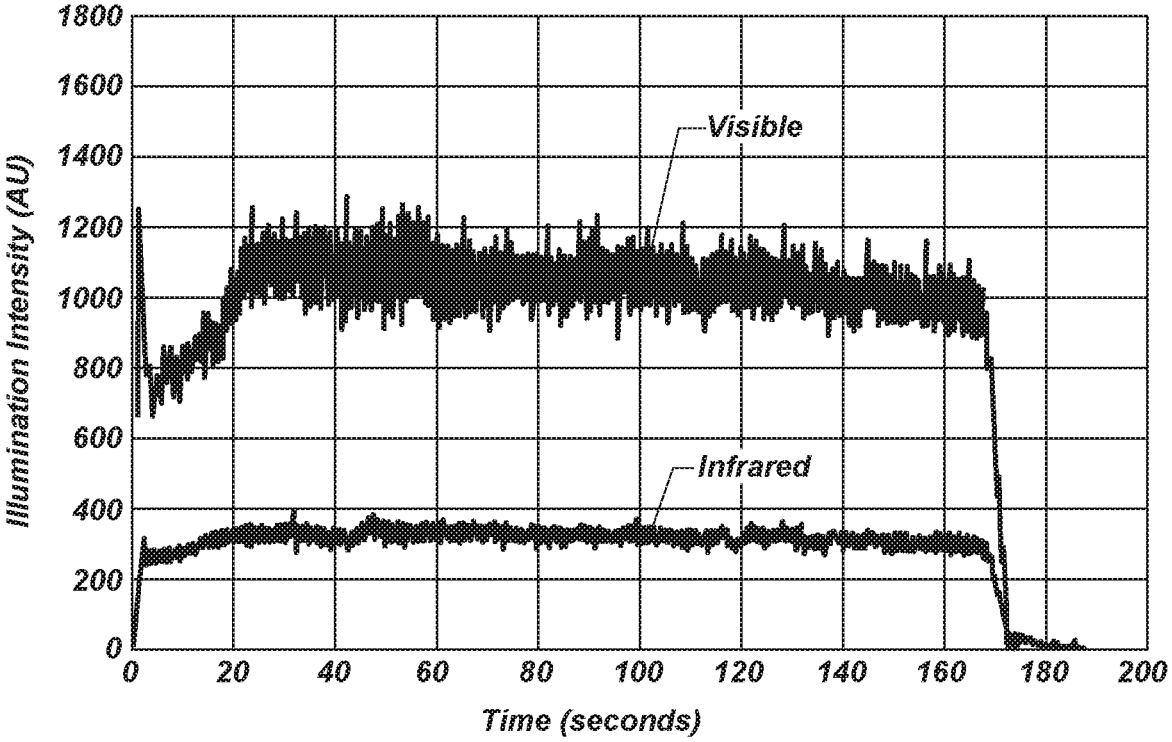
FIGS. 3-5 are graphs showing illumination intensity as a function of time of a liner in accordance with embodiments of the disclosure compared to control samples.
Figure 4:
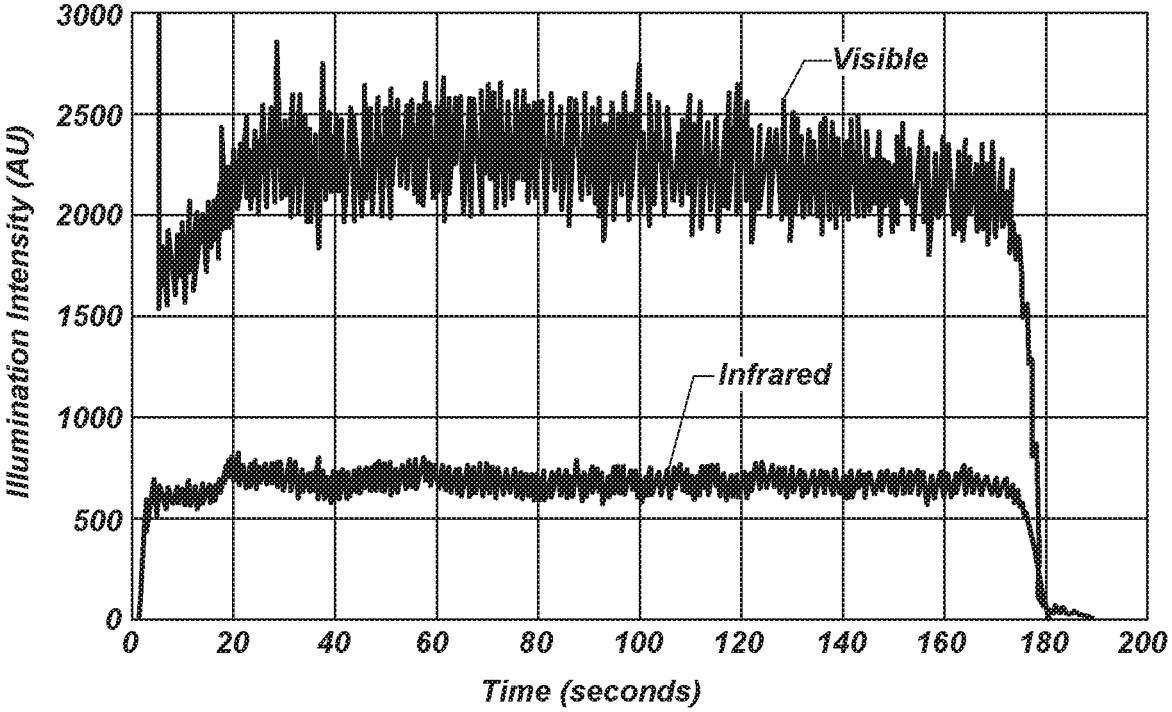

Spectral properties of the Compositions of Examples 1 and 2 were determined by conventional techniques. FIG. 3 shows the spectral properties of Composition 5 (including zinc borate) and FIG. 4 shows the spectral properties of Composition 5 (including zinc borate and ATH) as a function of time. The upper line of each graph indicates the illumination intensities at wavelengths in the visible region and the lower line indicates the illumination intensities at wavelengths in the IR region.

Figure 5:
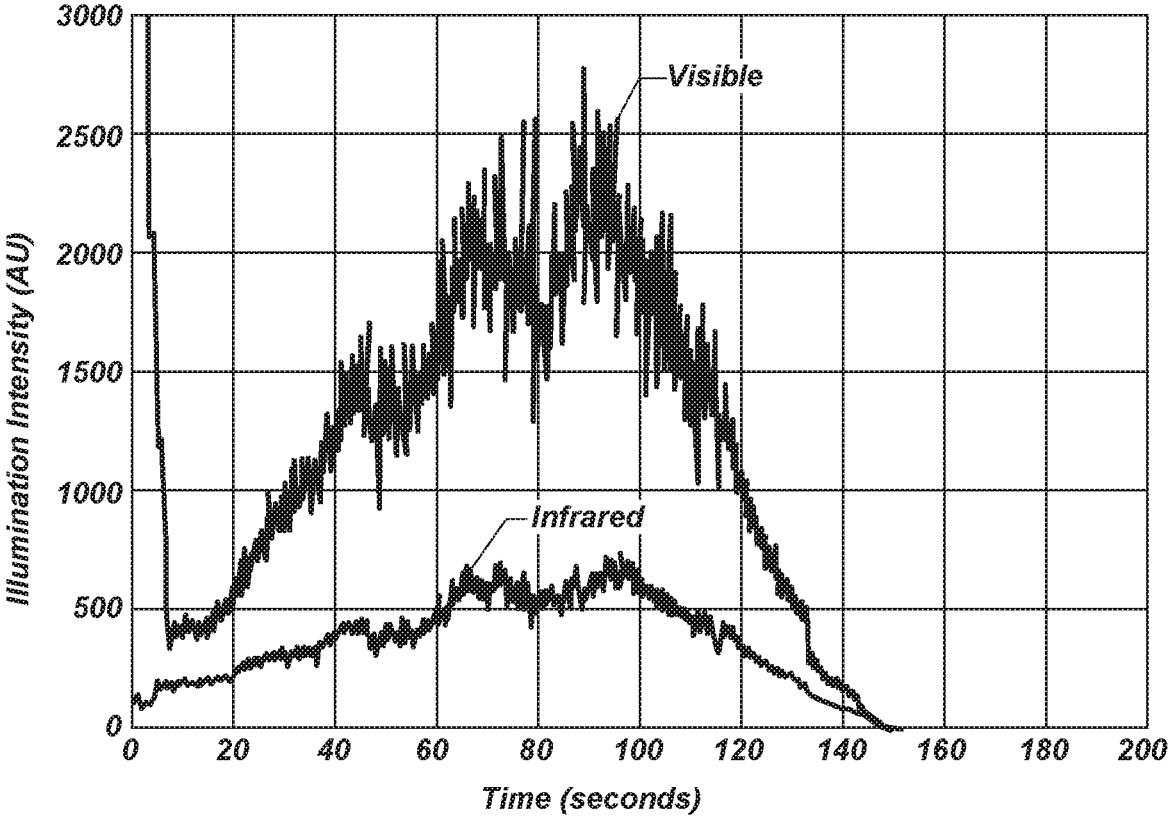

Compositions 4 and 5 showed constant illumination intensities compared to the peak high illumination intensities of the carbon black/HTPB composition, shown in FIG. 5. Compositions 4 and 5 also maintained the illumination intensities for longer burn times compared to the burn time of the carbon black/HTPB composition.

While the disclosure is susceptible to various modifications and alternative forms, specific embodiments have been shown by way of example in the drawings and have been described in detail herein. However, the disclosure is not intended to be limited to the particular forms disclosed. Rather, the disclosure encompasses all modifications, equivalents, and alternatives falling within the scope of the disclosure as defined by the following appended claims and their legal equivalents.

What is claimed is:

1. A flare comprising:

an illuminant adjacent to a casing of a flare; and a liner between the casing and the illuminant, the liner comprising:

a reaction product of a prepolymer and a curative; and one or more of a zinc oxide material or an aluminum oxide material.

2. The flare of claim 1, wherein the zinc oxide material comprises zinc borate.

3. The flare of claim 1, wherein the aluminum oxide material comprises aluminum trihydroxide.

4. The flare of claim 1, wherein the liner comprises zinc borate and aluminum trihydroxide in the reaction product of the prepolymer and the curative.

5. The flare of claim 1, wherein the prepolymer comprises a hydroxyl-terminated polybutadiene (HTPB), a hydroxyl-terminated polyether (HTPE), a hydroxyl-terminated polypropylene glycol, a hydroxyl terminated polyester, a carboxyl-terminated polybutadiene (CTPB), a carboxyl-terminated polyester, a carboxyl terminated polybutadiene-acrylonitrile (CTBN), ethylene propylene diene monomer (EPDM), acrylonitrile butadiene rubber (NBR), or a combination thereof.

6. The flare of claim 1, wherein the liner is substantially free of carbon black.

7. The flare of claim 1, wherein the liner is substantially free of fibers.

8. The flare of claim 1, wherein the illuminant is formulated to produce electromagnetic radiation at wavelengths in one or more of the visible region of the electromagnetic radiation spectrum or the infrared region of the electromagnetic radiation spectrum.

9. The flare of claim 1, wherein the reaction product comprises a polymer matrix, and zinc borate and aluminum trihydroxide are dispersed in the polymer matrix.

10. The flare of claim 1, wherein the liner directly contacts the illuminant.

11. The flare of claim 1, wherein the liner directly contacts the casing.

12. A method of forming a flare, comprising:

forming a precursor liner composition comprising a prepolymer, one or more of a zinc oxide material or an aluminum oxide material, and a curative;

applying the precursor liner composition to a casing or to an illuminant of a flare; and curing the precursor liner composition to form a liner on the casing or on the illuminant.

13. The method of claim 12, wherein forming a precursor liner composition comprises combining the prepolymer, one or more of zinc borate or aluminum trihydroxide, and the curative.

14. The method of claim 12, further comprising combining one or more of titanium dioxide, silicon dioxide, or microspheres with the prepolymer, the one or more of zinc borate or aluminum trihydroxide, and the curative.

15. A method of forming a flare, comprising:

forming a precursor liner composition comprising a prepolymer, one or more of zinc borate or aluminum trihydroxide, and a curative;

curing the precursor liner composition to form a liner; and applying the liner to at least a portion of a casing or to at least a portion of an illuminant of a flare.

16. The method of claim 15, wherein forming a precursor liner composition comprises combining a hydroxyl-terminated polybutadiene (HTPB), the one or more of zinc borate or aluminum trihydroxide, and the curative.

17. The method of claim 15, wherein forming a precursor liner composition comprises combining ethylene propylene diene monomer (EPDM), the one or more of zinc borate or aluminum trihydroxide, and the curative.

18. The method of claim 15, wherein curing the precursor liner composition to form a liner comprises dispersing the one or more of a zinc oxide material or an aluminum oxide material in a reaction product of the prepolymer and the curative.

19. The method of claim 15, wherein applying the liner to at least a portion of a casing or to at least a portion of an illuminant comprises applying the liner to an inner surface of the casing.

20. The method of claim 15, wherein applying the liner to at least a portion of a casing or to at least a portion of an illuminant comprises applying the liner to an outer surface of the illuminant.

* * * * *